US012018925B2

(12) United States Patent
Ylisaukko-Oja et al.

(10) Patent No.: US 12,018,925 B2
(45) Date of Patent: Jun. 25, 2024

(54) WIRELESS ELECTRONIC INITIATION DEVICE, AN INITIATION ARRANGEMENT AND METHOD FOR INITIATION

(71) Applicants: NORMET OY, Iisalmi (FI); OY FORCIT AB, Hanko (FI)

(72) Inventors: Arto Ylisaukko-Oja, Vtt (FI); Antti Tanskanen, Vtt (FI); Esko Strommer, Vtt (FI); Timo Halme, Hanko (FI); Tommi Halonen, Hanko (FI); Anssi Mykkanen, Iisalmi (FI); Janne Lehto, Iisalmi (FI); Jouko Tenhunen, Iisalmi (FI)

(73) Assignees: Normet Oy, Iisalmi (FI); Oy Forcit AB, Hanko (FI)

( * ) Notice: Subject to any disclaimer, the term of this patent is extended or adjusted under 35 U.S.C. 154(b) by 1232 days.

(21) Appl. No.: 16/610,286

(22) PCT Filed: May 3, 2018

(86) PCT No.: PCT/FI2018/050324
§ 371 (c)(1),
(2) Date: Nov. 1, 2019

(87) PCT Pub. No.: WO2018/202953
PCT Pub. Date: Nov. 8, 2018

(65) Prior Publication Data

US 2023/0194228 A1 Jun. 22, 2023

(30) Foreign Application Priority Data

May 3, 2017 (FI) ..... 20175388

(51) Int. Cl.
*F42D 1/055* (2006.01)
*C06C 5/04* (2006.01)
(Continued)

(52) U.S. Cl.
CPC ..... *F42C 11/008* (2013.01); *C06C 5/04* (2013.01); *F42D 1/043* (2013.01); *F42D 1/055* (2013.01)

(58) Field of Classification Search
CPC ... F42D 1/043; F42D 1/05; F42D 1/02; F42D 1/042; F42D 1/055; F42D 3/04;
(Continued)

(56) References Cited

U.S. PATENT DOCUMENTS 4,777,880 A * 10/1988 Beattie ..... F42D 1/05 102/202
5,159,149 A 10/1992 Marsden
(Continued)

FOREIGN PATENT DOCUMENTS

JP 2001330400 A 11/2001
JP 2017036854 A 2/2017
(Continued)

OTHER PUBLICATIONS

International Search Report for PCT/FI2018/050324 of Aug. 29, 2018.
(Continued)

*Primary Examiner* — Michael D David
(74) *Attorney, Agent, or Firm* — Thomas | Horstemeyer, LLP

(57) ABSTRACT

A wireless electronic initiation device for a detonator via a shock tube comprises an initiation member for initiation the shock tube and an energy storage for providing initiation energy to said initiation member. The initiation device comprises also a wireless communication device with a receiver for receiving an initiation command in a wireless way from an initiation arrangement. The initiation device comprises also a controller, which is configured to determine said received initiation command and based on said received
(Continued)

initiation command configured to activate said initiation member to ignite the detonator initiator (108) by the energy fed from the energy storage.

18 Claims, 2 Drawing Sheets

(51) Int. Cl.
*F42C 11/00* (2006.01)
*F42D 1/04* (2006.01)

(58) Field of Classification Search
CPC .. F42B 3/121; F42B 3/11; F42B 3/113; F42B 3/08; F42C 11/06; F42C 11/008; C06C 5/04; C06C 5/06
USPC ..... 102/206, 275.1–275.8, 215, 262, 217, 102/218, 301, 201, 275.12; 361/248; 368/9
See application file for complete search history.

(56) References Cited

U.S. PATENT DOCUMENTS 6,941,870 B2 * 9/2005 McClure ..... F42D 1/055 102/311
7,327,550 B2 * 2/2008 Meyer ..... F42D 1/055 361/251
7,370,583 B2 * 5/2008 Bokvist ..... F42D 1/055 102/214
7,461,580 B2 * 12/2008 Bell ..... E21B 43/117 175/4.55
7,791,858 B2 * 9/2010 Hummel ..... F42D 1/05 361/247
7,810,430 B2 * 10/2010 Chan ..... F42B 3/121 102/214
7,874,250 B2 * 1/2011 Veneruso ..... F42D 1/05 137/68.13
7,963,833 B2 * 6/2011 Novak ..... A63F 13/30 463/2
8,109,191 B1 * 2/2012 Rudakevych ..... F42C 15/42 89/41.01
8,375,838 B2 * 2/2013 Rudakevych ..... F41H 7/005 89/27.11
8,395,878 B2 * 3/2013 Stewart ..... F42D 3/04 361/247
8,468,944 B2 * 6/2013 Givens ..... F42B 3/121 102/311
8,861,172 B2 * 10/2014 Hummel ..... F42D 1/045 361/247
9,243,879 B2 * 1/2016 Thomson ..... F42B 3/10
10,267,611 B2 * 4/2019 Lownds ..... F42D 5/00
10,429,162 B2 * 10/2019 Papillon ..... F42D 5/00
10,436,005 B2 * 10/2019 Mace ..... C06B 25/34
10,466,025 B2 * 11/2019 Venter ..... F42B 3/121
11,221,200 B2 * 1/2022 Kuk ..... F42D 1/045
11,248,895 B2 * 2/2022 Wicks ..... F42B 3/10
11,365,957 B2 * 6/2022 Hucker ..... F42C 17/04
11,493,315 B2 * 11/2022 Park ..... E21B 7/022
2005/0030695 A1 10/2005 Meyer
2008/0307993 A1 12/2008 Chan et al.
2012/0192744 A1 8/2012 Ballantine

FOREIGN PATENT DOCUMENTS

WO 03029748 A1 4/2003
WO 20060076777 A1 4/2006
WO 2014065676 A2 5/2014
WO 20160086242 A2 6/2016
WO 2017183662 A1 10/2017

OTHER PUBLICATIONS

Written Opinion for PCT/FI2018/050324 of Aug. 28, 2018.
Finnish Search Report for PCT/FI2018/050324 of Nov. 30, 2017.
Supplementary Partial European Search Report mailed Dec. 14, 2020 for EP Application No. 18794189.3.

* cited by examiner

WIRELESS ELECTRONIC INITIATION DEVICE, AN INITIATION ARRANGEMENT AND METHOD FOR INITIATION

CROSS-REFERENCE TO RELATED APPLICATIONS

This application is the 35 U.S.C. § 371 national stage application of PCT Application No. PCT/FI2018/050324, filed May 3, 2018, where the PCT claims priority to, and the benefit of, Finnish Application no. 20175388, filed May 3, 2017, both of which are herein incorporated by reference in their entireties.

TECHNICAL FIELD OF THE INVENTION

The invention relates to a wireless electronic initiation device, an initiation arrangement and method for initiation a wireless electronic initiation device.

BACKGROUND OF THE INVENTION

One known method for activating detonators for blasting is to use shock tubes coupled with the detonators and transporting an initiating signal to the detonators e.g. in a borehole in a rock from an initiation device. The shock tubes are then bound and bundled together and fed along a blasting site to the initiation device.

There are however some disadvantages relating to the known methods, such as binding and bundling lots of shock tubes together. The binding and bundling is very time consuming, as well as very dangerous especially when it is done in a tunnel, where there is a risk of falling rocks, for example. In addition there is also a risk for an accidental initiation of the detonators when the shock tubes are connected. Moreover, an automatic installation of the detonators and the shock tubes and overall system is impossible or at least extreme difficult because of the long shock tubes, which easily meddles with each other or with the environment and obstacles in the blasting site. Still, in addition when the initiation signals are provided to the detonators via long shock tubes, there is a risk that charges when blasting will cause damages to other shock tubes, whereupon some of the detonators will not receive initiation signal.

SUMMARY OF THE INVENTION

An object of the invention is to alleviate and eliminate the problems relating to the known prior art. Especially the object of the invention is to provide a wireless electronic initiation device, an initiation arrangement and method for initiation a wireless electronic initiation device so that the binding and bundling of the shock tubes or other long wires can be avoided and thereby fastening the process and thereby also minimise the risk to be in dangerous conditions. An object is also to provide a wireless electronic initiation device, an initiation arrangement and method for initiation a wireless electronic initiation device so that the binding and bundling of the shock tubes or other long wires with the wireless electronic initiation device can be avoided. An additional object of the invention is to enable automatic installation of the detonators and the overall initiation system. An object is also to eliminate the risk of an accidental initiation of the detonators when installation the detonators and initiation system. In addition an object is to provide a method and system for transmitting initiation signals in a reliable way and minimizing environmental disturbing effects and features.

The object of the invention can be achieved by the features of independent claims.

The invention relates to a wireless electronic initiation device for a detonator via a detonator initiator according to claim 1. In addition the invention relates to an initiation arrangement according to claim 11, a method for initiation a wireless electronic initiation device according to claim 17 and a use of the wireless initiation device according to claim 18.

According to an embodiment of the invention a wireless electronic initiation device for a detonator via a detonator initiator, such a shock tube or an electric fusehead, is provided. The detonator can be any detonator known from prior art, such as a pyrotechnic or electrical fusehead detonator. The initiation device comprises an initiation member for initiation or activating the detonator initiator and thereby transmitting the initiation signal to the detonator. The initiation device may comprise an output or connector for connecting the initiation device to the shock tube, such as electrodes implemented by teeth or pins, which can be pressed through the shock tube, for example, so that when ignite a spark is induced between the electrodes thereby activating the shock tube. Naturally also other types of connection methods can be utilized, such as an electric fuse or an initiation fuse head. As an example the initiation member can be inserted into or on the center hole of the shock tube, or the initiation member penetrated through the side wall of the shock tube. In addition the initiation device may comprise a connector for connecting the initiation device to the shock tube, such as a short length of the shock tube integrated into the initiation device or other tube via which the actual shock tube can be coupled with the initiation device.

According to an embodiment the initiation device may comprise a bunch connector for connecting the initiation device to number of shock tubes at the one connection maneuver. The bunch connector advantageously comprises number of outputs for connecting number of the shock tubes, which is advantageously prepared first, and then at least one input for connecting the initiation device. As an example, there may be, for example, ten shock tubes connected to the outputs of the bunch connector, after which the initiation device is connected to the input of the bunch connector.

According to an advantageous embodiment the initiation device is configured to receive energy in a wireless manner outside from the initiation device and additionally to charge a energy storage by the received energy. In addition the initiation device is configured also to receive an initiation command in a wireless way outside from the initiation device.

The initiation device may comprise a first wireless communication device with a receiver for receiving said initiation command and said energy. Alternatively, or in addition to, the initiation device may also comprise a second wireless communication device for receiving said energy, whereupon the first wireless communication device can be used only for receiving said initiation command or both the initiation command and energy.

According to an embodiment the initiation device comprises the first wireless communication device with a receiver for receiving an initiation command in a wireless way outside from the initiation device. The first wireless communication device is advantageously a radio communication device, but can also be implemented by an acoustic receiver or optical or inductive receiver, which is configured for receiving an initiation command in a wireless way outside from the initiation device.

The initiation device also comprises the energy storage for providing initiation energy to the initiation member after charged. The energy storage may be e.g. a capacitor, a supercapacitor or a battery. It is advantageous to use a chargeable energy storage that can be charged in a wireless manner outside the initiation device. The wireless charging offers clear safety advantage namely the energy storage can be kept left or at least at so low level that it is unable to provide enough energy for the shock tube for initiation. Thus the initiation device and the detonators can be installed safely. It is to be noted that the initiation device may comprise a separate energy storage, such as a battery or capacitor or the like for providing energy for wireless communication.

The initiation device comprises advantageously also a controller, which advantageously controls e.g. an operation of an initiation circuit as well as determines the received initiation command and its authenticity. Based on the received initiation command the controller advantageously activates the initiation member to ignite the detonator initiator, such as the shock tube, by the energy fed from the energy storage, if the received initiation command was correct and for the initiation device in question. The initiation circuit can be used for example for feeding initiation energy from the energy storage to the initiation member under control of the controller.

The initiation device may also comprise a second wireless communication device, which is configured to receive energy in a wireless manner outside from the initiation device and charge the energy storage, such as the capacitor, by the received energy using e.g. a regulator and other suitable additional equipment. The second wireless communication device is according to an embodiment radio receiver, but can also be implemented by another technique such as by an induction receiver, acoustic receiver or optic receiver. The form of the energy delivered depends naturally on the used technique. For example, according to an embodiment, said energy may be electromagnetic radiation, especially high or ultrahigh frequency radio waves, and in particularly microwave radiation having frequency in the range of 2-4 GHz, most advantageously around 2.45 GHz. The transmit power may be for example 500 W.

The initiation device advantageously controls the charging process of the energy storage. In particularly the controller allows the activation of the initiation member only when the energy storage is charged enough to provide initiation energy suitable to execute initiation command sequence and then finally ignite the detonator initiator, like the shock tube.

When the energy storage is charged enough to provide energy suitable to execute initiation command sequence, the initiation device establishes a communication test with at least two different frequencies with the first wireless communication device to an initiation arrangement. The initiation arrangement comprises at least one first transceiver for communicating with said first wireless communication device of the initiation device. According to an embodiment the initiation device may transmit the communication test using one or more frequencies and the initiation arrangement may respond using one or more frequencies. After this the initiation device selects, via the communication test with the initiation arrangement, the frequency with highest signal strength to be used for receiving said initiation command, or when the signal having strength over a predetermined threshold value is established, said frequency is selected, even if it was the first frequency. According to an embodiment of the invention, when all initiation devices in the blasting site have established the communication test with the initiation arrangement, the initiation arrangement provides the initiation commands in to the wireless electronic initiation devices by transmitting the initiation command in a wireless way to the initiation devices.

It is to be noted that the steps can also be performed in other order so that the communication test is performed first and when it is accepted and the frequency for communication is selected, and after that the energy is received and the energy storage loaded.

Most advantageously the initiation arrangement transmits the initiation command by sweeping the transmission frequency in a predetermined transmission frequency range covering at least the frequencies used by the initiation devices in order to assure that the communication is not disturbed by a multipath fading for the plurality of the initiation devices.

According to an embodiment the first and second wireless communication devices can be implemented by one device, as described elsewhere in this document. The first and second wireless communication devices of the initiation device may also be different and separate devices functioning with different frequencies, whereupon one can be sure that they are not disturbing each other. However according to an embodiment both devices can also function with the same frequency range, whereupon the initiation command advantageously comprises a code identifying the initiation command so that the initiation device can be determine whether the initiation command is as an acceptable initiation command and thereby either ignore or running said initiation command in order to activate the initiation member to ignite the detonator initiator by the energy fed from the energy providing member. The initiation command may also comprise a delay or timing information so that the initiation device can control the timing of running the initiation command.

As discussed elsewhere in this document the initiation arrangement comprises at least one first transmitter for transmitting the initiation command in a wireless way to the initiation device. In addition to that the initiation arrangement advantageously comprises also a second transmitter for transmitting energy in a wireless manner to the initiation device in order to charge the energy storage by said transmitted energy. The second transmitter is advantageously a radio transmitter for transmitting said energy via radio waves, but can also be implemented in other ways depending on the techniques used, such as being an induction transmitter for transmitting said energy via induction, or an acoustic transmitter for transmitting said energy via acoustic waves or optical transmitter for transmitting said energy optically.

Alternatively or in addition to the first transmitter may also be used to transmit also energy in a wireless manner to the initiation device in order to charge said energy storage said transmitted energy.

The initiation device is advantageously implemented as a mobile module, which can be connected to the detonator via the detonator initiator, such as the shock tube. The shock tube used is advantageously only a short tube, the other end of which is coupled with the detonator and the other end of which is coupled to the initiation device. The initiation device as such is advantageously configured to be mounted on or into a borehole to which said detonator is to be installed. Most advantageously the initiation device is configured to be located outside the bore hole thereby allowing better transmission and propagation of the radio waves used for example for initiation commands and for charging the energy storage.

The present invention offers advantages over the known prior art, such as described in this document. Especially the wireless charging offers clear safety advantage namely the energy storage of the initiation device can be kept empty or at least at so low level that it is unable to provide enough energy for the shock tube for initiation. Thus the initiation device and the detonators can be installed safely without risk for blasting too early or in unwanted situation. In addition the initiation commands are transmitted by sweeping the predetermined transmission frequency range covering at least the frequencies used by the initiation devices in order to assure that the communication is not disturbed by a multipath fading for the plurality of the initiation devices. Moreover the initiation devices are configured to make communication tests before the initiation commands are transmitted and to select the frequency having power with strength over a predetermined threshold value, or if over one frequencies are used, to select the frequency from at least two different frequencies which has stronger transmit power.

The exemplary embodiments presented in this text are not to be interpreted to pose limitations to the applicability of the appended claims. The verb "to comprise" is used in this text as an open limitation that does not exclude the existence of also unrecited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objects and advantages thereof, will be best understood from the following description of specific example embodiments when read in connection with the accompanying drawings.

BRIEF DESCRIPTION OF THE DRAWINGS

Next the invention will be described in greater detail with reference to exemplary embodiments in accordance with the accompanying drawings, in which.

DETAILED DESCRIPTION

Figure 1:
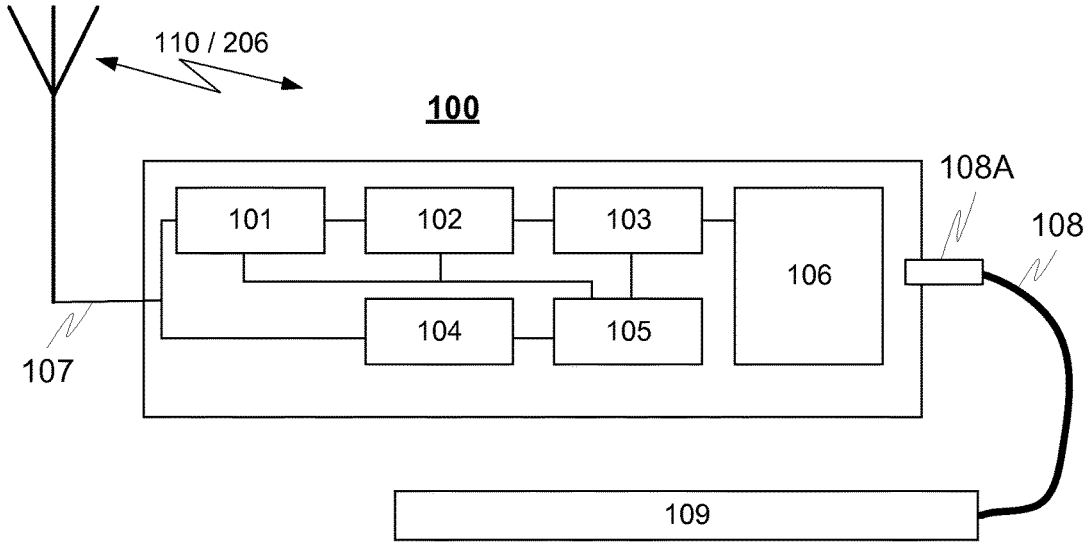
FIG. 1 illustrates a principle of an exemplary wireless electronic initiation device according to an advantageous embodiment of the invention.

FIG. 1 illustrates a principle of an exemplary wireless electronic initiation device 100 according to an advantageous embodiment of the invention for a detonator 109 via a shock tube 108. The initiation device 100 comprises an initiation member 106 for initiation or activating the shock tube 108. In addition the initiation device comprises advantageously a first wireless communication device 101 with a receiver for receiving an initiation command in a wireless way outside from the initiation device. For wireless communication the initiation device comprises an antenna 107 for receiving and transmitting radio waves, but can also be implemented by an acoustic transceiver or optical or inductive transceiver devices.

The initiation device comprises also an energy storage 105, such as a battery or a loadable capacitor. In addition the initiation device 100 comprises also a controller 102 for controlling e.g. an operation of an initiation circuit 103 (optional) as well as for determining the received initiation command and its authenticity and other task described elsewhere in this document.

The initiation device comprise also advantageously a second wireless communication device 104 for receiving energy in a wireless manner outside from the initiation device and charge the energy storage 105. The second wireless communication device 104 is according to an embodiment radio receiver using either own antenna (not shown) or a common antenna 107 with the first wireless communication device 101, but can also be implemented by another technique such as by an induction receiver, acoustic receiver or optic receiver.

It is to be noted that even if the first and second wireless communication devices 101, 104 are illustrated as separate devices, they can also be implemented, according to an embodiment of the invention, by integrating to one IC circuit, or they can be implemented by one device 101, as described elsewhere in this document.

According to an embodiment the initiation device 100 may also comprise a connector 108A for connecting the initiation device to the detonator initiator, such as the shock tube 108 in Figures. However, this is an optional feature.

Figure 2:
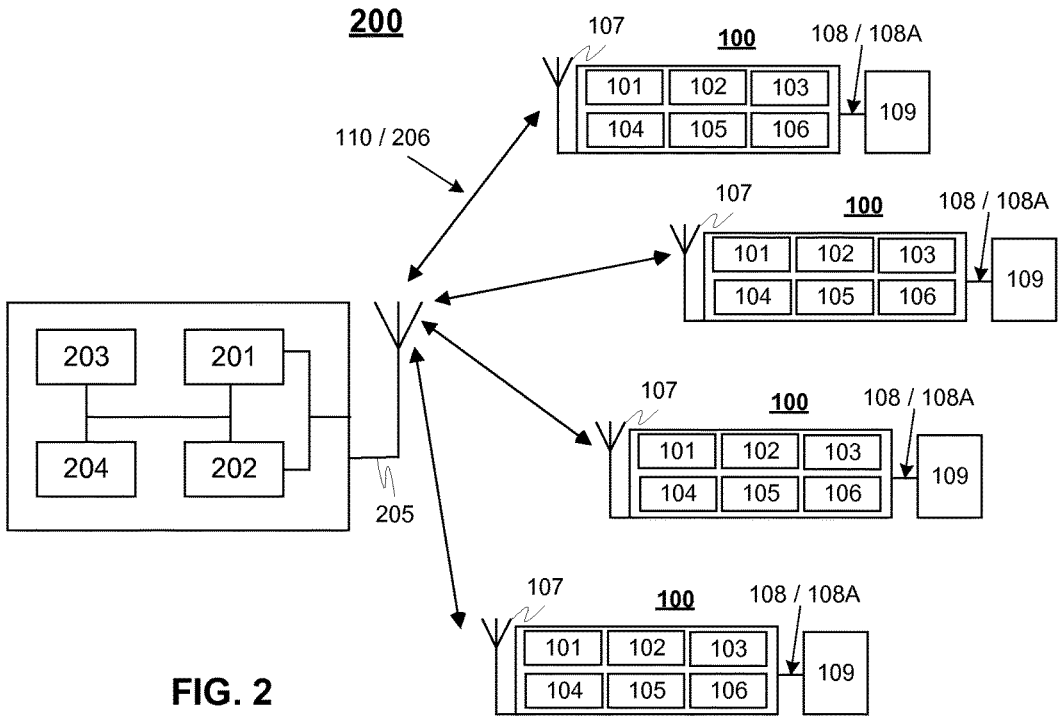
FIG. 2 illustrates an exemplary initiation arrangement for controlling the operation of the wireless electronic initiation device according to an advantageous embodiment of the invention.

FIG. 2 illustrates an exemplary initiation arrangement 200 for controlling the operation of the wireless electronic initiation device 100 or advantageously number of wireless electronic initiation device 100. The initiation arrangement 200 comprises at least one first transceiver 201 for transmitting initiation commands in a wireless way 206 to the initiation device 100. The first transceiver can be implemented by a radio transceiver transmitting said initiation commands by sweeping the transmission frequency in a predetermined transmission frequency range covering the frequencies used by the initiation devices 100 in order to assure a multipath fading that communication is not disturbed by a multipath fading for the plurality of the initiation devices. As discussed elsewhere in this document the first transceiver can also be implemented by other techniques known by the skilled person for transmitting signals, like the initiation commands.

According to an embodiment the first transceiver can also transmit energy in a wireless manner 206 to the initiation devices 100 in order to charge the energy storages 105 in the initiation devices. The first transceiver can operate in this embodiment e.g. with different frequencies for transmitting energy and the initiation commands.

According to an embodiment the initiation arrangement 200 comprises also a second transceiver or transmitter 202 for transmitting said energy in a wireless manner 206 to the initiation devices in order to charge the energy storages 105 of the initiation devices. The second transceiver or transmitter 202 can be implemented by a radio transceiver or transmitter for transmitting said energy via radio waves. Alternatively the second transceiver or transmitter can be implemented by other techniques known by the skilled person as is discussed in this document elsewhere.

In operation the initiation arrangement 200 transmits 206 at first the energy used for charging and at the same time or next is configured to receive communication signals 110 from the initiation devices 100. However the steps can be performed also in other order so to establish the communication first and after this transferring said energy. Each of the initiation devices 100 controls the charging process of its energy storage 105. When the energy storage 105 is charged enough to provide energy suitable to execute initiation command sequence, the initiation device in question establishes a communication test 110 with at least two different frequencies with the first wireless communication device 101 to an initiation arrangement 200. The initiation arrangement can receive these communications with different frequencies by the first transceiver 201 and send back 206 communication signals by these different frequencies. The initiation device is configured to receive these communication signals 206 and selecting the frequency with the highest signal strength to be used after for receiving the initiation command send by the initiation arrangement.

When all initiation devices 100 in the blasting site have established the communication test with the initiation arrangement 200 or other parameters are fulfilled (like at least a certain percent of the initiation devices are ready and a certain predetermined time has lapsed), the initiation arrangement 200 provides the initiation commands to the wireless electronic initiation devices 100 by transmitting the initiation command in a wireless way 206 to the initiation devices 100 by sweeping the transmission frequency in a predetermined transmission frequency range covering at least the frequencies used by the initiation devices in order to assure that the communication is not disturbed by a multipath fading for the plurality of the initiation devices.

The initiation arrangement 200 comprises also advantageously own energy storage 203 and/or energy receiving means for receiving energy outside, such as from an electricity network (not shown), as well as a controller 204 for controlling the energy transmission and sending from the energy storage 203 via said first and/or second transceiver and an antenna 205 to the initiation devices 100. The controller 205 is also configured to manage said radio communication, so receiving the communication tests 110 with at least one or more different frequencies and managing the back communication with at least one or more different frequencies.

According to an embodiment the wireless electronic initiation devices 100 can also send the communication test 110 only by one frequency listened by the initiation arrangement 200, whereafter the initiation arrangement 200 sends back 206 the communication signals by at least one or more different frequencies from which the initiation devices 100 select suitable frequency to be used for receiving the initiation commands.

Figure 3:
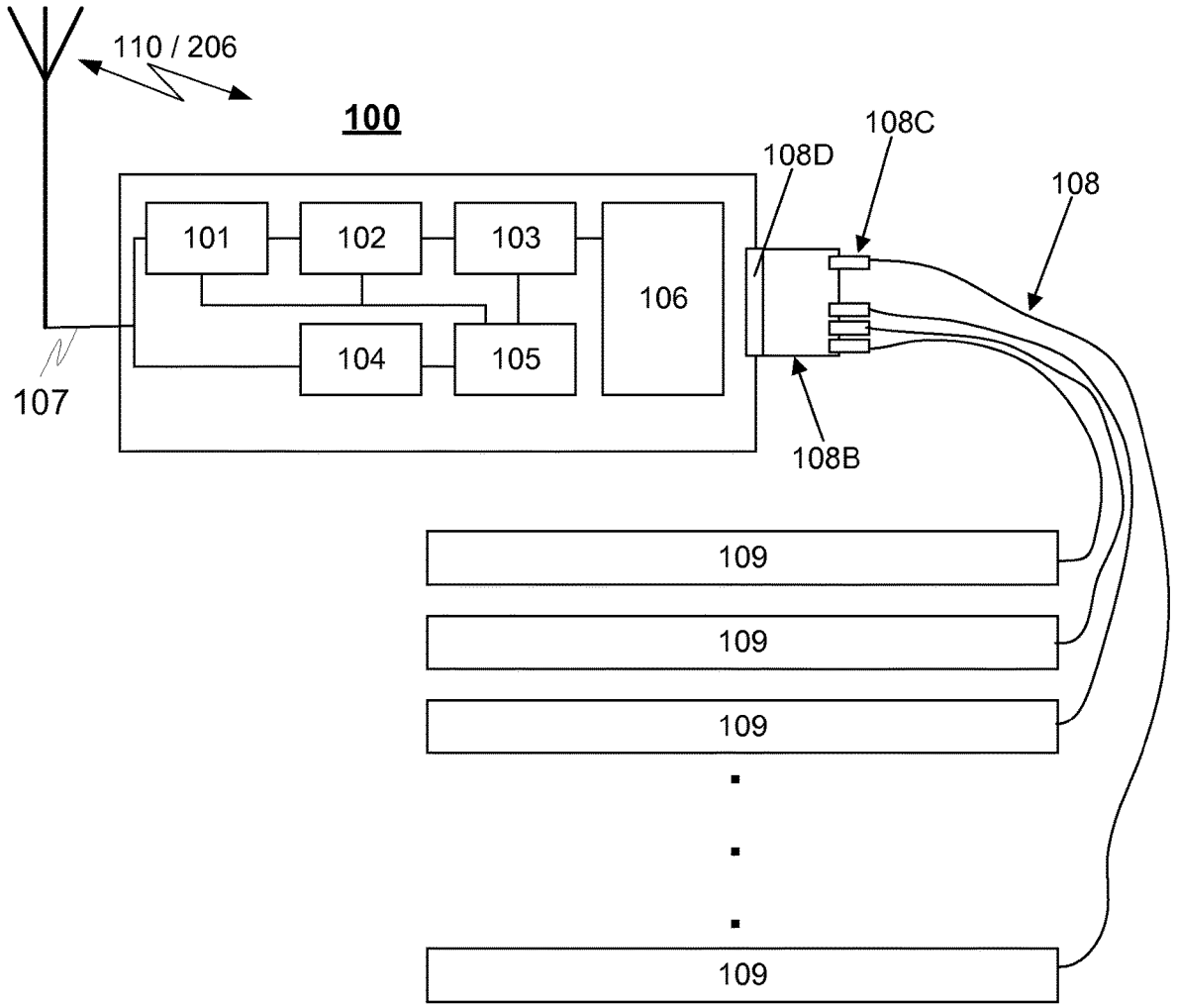
FIG. 3 illustrates a principle of an exemplary wireless electronic initiation device with a bunch connector according to an advantageous embodiment of the invention.

FIG. 3 illustrates a principle of an exemplary wireless electronic initiation device 100 with a bunch connector 108B according to an advantageous embodiment of the invention. The bunch connector 108B is in principle similar as the connector 108A described elsewhere in this document, but the bunch connector 108B comprises number of outputs 108C for connecting number of the shock tubes 108. Advantageously the number of shock tubes 108 are connected first to the outputs 108C of the bunch connector 108B, after which the initiation device 100 is connected to the input 108D of the bunch connector 108B.

The invention has been explained above with reference to the aforementioned embodiments, and several advantages of the invention have been demonstrated. It is clear that the invention is not only restricted to these embodiments, but comprises all possible embodiments within the spirit and scope of the inventive thought and the following patent claims. In particularly it is to be noted that even if the shock tube is illustrated in Figures and in many embodiments, it is only an example and that the detonator initiator can also implemented by an electric fusehead.

In addition it is to be noted that even if two separate wireless communication devices are illustrated in Figures and in many embodiments, the device may either comprise a first wireless communication device for receiving said initiation command and said energy, or a first wireless communication device for receiving said initiation command, and in addition a second wireless communication device for receiving said energy.

The features recited in dependent claims are mutually freely combinable unless otherwise explicitly stated.

The invention claimed is:

1. A wireless electronic initiation device for a detonator via a detonator initiator, comprising:

an initiation member for initiating a detonator initiator, an energy storage for providing initiation energy to said initiation member, and a controller, wherein said wireless electronic initiation device is configured to receive energy in a wireless manner outside from the initiation device and the initiation device is configured to charge said energy storage by the received energy, and an initiation command in a wireless way outside from the initiation device, wherein said controller is configured to manage said charging process of said energy storage, to determine said received initiation command, and based on said received initiation command configured to activate said initiation member to ignite the detonator initiator by the energy fed from the energy storage, and wherein the initiation device additionally comprises a connector configured to connect the detonator initiator, which is a separate component from the initiation device, to the initiation device to connect the detonator, which also is a separate component from the initiation device, to said initiation device only via said connector and said detonator initiator.

2. The initiation device of claim 1, wherein the initiation device comprises: a first wireless communication device with a receiver for receiving said initiation command and said energy, or a first wireless communication device with a receiver for receiving said initiation command, and in addition a second wireless communication device for receiving said energy.

3. The initiation device of claim 2, wherein said first and/or second wireless communication device(s) is/are an induction receiver, acoustic receiver, optic receiver or radio receiver and said energy received by said radio receiver is electromagnetic radiation, especially high or ultrahigh frequency radio waves, and in particularly microwave radiation having frequency in the range of 2-4 GHz, most advantageously around 2.45 GHz for receiving said initiation command and/or said energy.

4. The initiation device of claim 2, wherein the first and second wireless communication devices are implemented either by one device or two different devices.

5. The initiation device of claim 2, wherein the first and second wireless communication devices are functioning with different frequencies; or wherein the both devices are functioning with same frequency range, whereupon the initiation command comprises a code identifying said initiation command to be as an acceptable initiation command.

6. The initiation device of claim 1, wherein said initiation command comprises identification code based of which the initiation device either ignore running said initiation command and if said identification code matches with the identification code of the initiation device in question, said initiation device is then configured to run said initiation command in order to activate said initiation member to ignite the detonator initiator by the energy fed from the energy storage; or wherein said initiation command comprises a delay or timing information for controlling the timing of running said initiation command by the initiation device in order to activate said initiation member to ignite the detonator initiator by the energy fed from the energy storage.

7. The initiation device of claim 1, wherein said initiation device is configured to control the charging process of the energy storage and allowing said activation of said initiation member only when the energy storage is charged enough to provide energy suitable to execute initiation command sequence and then finally ignite the detonator initiator.

8. The initiation device of claim 1, wherein the initiation device is configured to establish a communication test with at least two different frequencies and select the frequency with highest signal strength to be used for receiving said initiation command.

9. The initiation device of claim 1, wherein said energy storage comprises a capacitor, a supercapacitor, or a rechargeable battery to be charged by said energy received in the wireless manner.

10. The initiation device of claim 1, wherein said detonator initiator is a shock tube or an electric fuse head for initiating said detonator.

11. The initiation device of claim 1, wherein the connector is a bunch connector comprising at least one input for connecting the initiation device and at least two outputs for connecting at least two shock tubes.

12. An initiation arrangement for controlling the operation of the wireless electronic initiation device according to claim 1, wherein the initiation arrangement comprises the wireless electronic initiation device and at least one first transmitter for transmitting said initiation command in a wireless way to the initiation device.

13. The initiation arrangement of claim 12, wherein the first transmitter is configured to transmit said initiation command to the initiation devices by sweeping the transmission frequency in a predetermined transmission frequency range covering the frequencies used by the initiation devices in order to assure that communication is not disturbed by a multipath fading.

14. The initiation arrangement of claim 12, wherein said first transmitter is configured to transmit also energy in a wireless manner to the initiation device in order to charge said energy storage of the initiation device by said transmitted energy.

15. The initiation arrangement of claim 12, wherein the initiation arrangement comprises a second transmitter for transmitting energy in a wireless manner to the initiation device in order to charge said energy storage of the initiation device by said transmitted energy.

16. The initiation arrangement of claim 15, wherein the second transmitter is a radio transmitter for transmitting said energy via radio waves, an induction transmitter for transmitting said energy via induction, or an acoustic transmitter for transmitting said energy via acoustic waves or an optical transmitter for transmitting said energy optically.

17. A method for initiating a wireless electronic initiation device for a detonator via a detonator initiator, comprising steps of:

providing an initiation member of the initiation device for initiating the detonator initiator, receiving energy in a wireless manner outside from the initiation device, charging an energy storage of the initiation device by the received energy, providing initiation energy to said initiation member from the energy storage, receiving an initiation command in a wireless way outside from the initiation device, and determining, by a controller, said received initiation command and, based on said received initiation command, activating said initiation member to ignite the detonator initiator by the energy fed from the energy storage, wherein the method further comprises a step of connecting, by a connector, the detonator initiator, which is a separate component from the initiation device, to the initiation device to connect the detonator, which also is a separate component from the initiation device, to said initiation device only via said connector and said detonator initiator.

18. Use of the wireless initiation device of claim 1 in a blasting operation.

* * * * *